US007256685B2

(12) United States Patent
Gotfried

(10) Patent No.: US 7,256,685 B2
(45) Date of Patent: Aug. 14, 2007

(54) APPLAUSE DEVICE

(76) Inventor: Bradley Gotfried, 8949 SE. Bridge Rd., Hobe Sound, FL (US) 33465

( * ) Notice: Subject to any disclaimer, the term of this patent is extended or adjusted under 35 U.S.C. 154(b) by 0 days.

(21) Appl. No.: 10/339,592

(22) Filed: Jan. 9, 2003

(65) Prior Publication Data

US 2003/0102977 A1 Jun. 5, 2003

Related U.S. Application Data

(63) Continuation-in-part of application No. 09/619,008, filed on Jul. 19, 2000, now Pat. No. 6,538,565.

(51) Int. Cl.
*G08B 3/10* (2006.01)

(52) U.S. Cl. ..... 340/384.3; 340/384.1; 340/384.4; 340/384.7; 340/691.1; 340/691.2; 340/691.6; 340/692

(58) Field of Classification Search ..... 340/384.3, 340/384.1, 384.4, 384.7, 691.1, 691.2, 692, 340/691.4, 691.6, 574; 362/103, 105, 311; 368/103, 105, 310, 311
See application file for complete search history.

(56) References Cited

U.S. PATENT DOCUMENTS

| | | | | |
|---|---|---|---|---|
| 4,397,210 | A * | 8/1983 | Finch | 84/1.03 |
| 4,486,975 | A | 12/1984 | Harreld et al. | |
| 4,556,932 | A | 12/1985 | Lehrer et al. | |
| 4,992,704 | A | 2/1991 | Stinson | |
| 5,064,195 | A | 11/1991 | McMahan et al. | |
| 5,112,266 | A * | 5/1992 | Hall | 446/422 |
| 5,137,488 | A | 8/1992 | Yeh | |
| 5,259,807 | A | 11/1993 | Crow | |
| D371,785 | S | 7/1996 | Dicampli et al. | |
| 5,674,076 | A | 10/1997 | Billings et al. | |
| 5,726,701 | A * | 3/1998 | Needham | 348/2 |
| 5,847,652 | A * | 12/1998 | Yamamoto | 340/574 |
| 5,855,006 | A * | 12/1998 | Huemoeller et al. | 705/9 |
| 5,859,915 | A * | 1/1999 | Norris | 381/75 |
| 5,881,384 | A | 3/1999 | Williams | |
| 5,973,250 | A * | 10/1999 | Zirille et al. | 84/600 |
| 5,989,098 | A * | 11/1999 | Reynolds et al. | 446/485 |
| 6,007,211 | A | 12/1999 | Cheung | |
| 6,020,823 | A * | 2/2000 | DeCico | 340/691.2 |
| 6,137,410 | A * | 10/2000 | Sepulveda | 340/568.7 |
| 6,148,175 | A * | 11/2000 | Freeland | 455/3.1 |
| 6,161,266 | A | 12/2000 | Anscher | |
| 6,304,761 | B1 * | 10/2001 | Tsunehiro | 455/553 |

FOREIGN PATENT DOCUMENTS

| | | | |
|---|---|---|---|
| CN | 2149941 | Y | 12/1993 |

* cited by examiner

*Primary Examiner*—Hung Nguyen
(74) *Attorney, Agent, or Firm*—Akerman Senterfitt

(57) ABSTRACT

An applause device including a sound generator capable of generating at least one applause sound. The sound generator preferably can generate at least one sound which can indicate approval or disapproval, such as clapping, hollering, whistling, booing, and hissing. A switch permits the user to select between each of the sounds. The device also preferably comprises illumination structure so as to illuminate at least a portion of the sound generation device. In a preferred embodiment, the applause device is shaped substantially, at least in part, in the shape of an open hand. A method for generating applause sounds and a system for remotely controlling the applause device is also disclosed.

12 Claims, 3 Drawing Sheets

APPLAUSE DEVICE

CROSS-REFERENCE TO RELATED APPLICATIONS

This application is Continuation-In-Part of application Ser. No. 09/619,008, filed Jul. 19, 2000 now U.S. Pat No. 6,538,565.

FIELD OF THE INVENTION

This invention relates generally to portable sound generating devices, and more particularly to such devices that are used at sporting events, concerts, and other entertainment events.

BACKGROUND OF THE INVENTION

Sporting events, concerts and other entertainment events create the desire on the part of the audience to express approval or disapproval with the entertainment. In many cases, it is difficult to maintain a vocal presence without straining one's voice. Many attendees wish to also make a visual statement and, accordingly, wear hats and bring signs or other paraphernalia to hold up and waive so as to make a visual statement. Various noisemakers and compressed air sounding machines have previously been provided for attendees to make various sounds to signify their support, approval or disapproval. These devices do not permit the user to make a visual statement in a darkened stadium or auditorium. Also, the noisemakers generally produce sounds which are loud, but do not have any particular significance to the event.

SUMMARY OF THE INVENTION

An applause device, according to the invention, includes a housing and an applause sound generating device in the housing. The applause sound can be any suitable applause sound, and can be selected from sounds such as clapping, hollering, and whistling. The invention is not limited in that regard, however, as any sound which expresses approval or disapproval is acceptable. The applause device also preferably includes lighting structure. The lighting structure for lighting the applause device permits a visual statement in a darkened environment. In a preferred embodiment, the applause device is fashioned substantially in the shape of an open hand, so as to suggest applause.

Preferably, at least a portion of the housing comprises a light-emitting portion. The applause device preferably has a light source in the housing and a switch on the housing, wherein the switch activates the light source. As a result, the light-emitting portion is illuminated. The light-emitting portion can be translucent and/or transparent and, in a particularly preferred embodiment is formed at least partially of translucent plastic.

The applause device can have a switch on the housing, wherein the switch activates the applause sound generating device. The housing can have one or more apertures, so that at least a portion of the applause sound generated by the applause sound generating device can escape from the housing through the apertures.

The applause device can also include attachment structure attached to the housing. The attachment structure can be at least one of the group consisting of a hook, a ring, or a first synthetic material which detachably connects to a second synthetic material when the first and second materials are pressed together.

In an alternative embodiment of the invention, the applause device can include a housing having a light-emitting portion formed from material which is translucent and/or transparent, an applause sound generating device in the housing, a sound switch on the housing which activates the applause sound generating device, a light source in the housing, and an illuminating switch on the housing. The illuminating switch can activate the light source, whereby the light-emitting portion is illuminated.

A method for applauding, according to the invention, includes providing a device having an applause sound generating device, and operating the applause sound generating device to generate a sound of applause. The applause sound can be clapping, hollering, and/or whistling, although the invention is not limited in that regard, as any sound which expresses approval or disapproval is acceptable.

The method can also include a step of illuminating the applause device. The illuminating step can include providing a housing, wherein at least a portion of the housing comprises a light-emitting portion. The illuminating step can also include providing a light source in the housing and a switch on the housing, wherein the switch activates the light source, and configuring the switch to activate the light source. The light-emitting portion can be translucent and/or transparent and, in a particularly preferred embodiment is formed at least partially of translucent plastic.

The method can include providing a housing at least partially in the shape of an open hand. A switch can be provided on the housing, wherein the switch activates the applause sound generating device, causing the switch to activate the applause sound generating device. The method can also include providing at least one aperture in the housing, wherein at least a portion of the applause sound generated by the applause sound generating device escapes from the housing through the apertures.

The method can include attaching attachment structure to the housing. The attachment structure can be at least one of the group consisting of a hook, a ring, or a first synthetic material which detachably connects to a second synthetic material when the first and second materials are pressed together.

In another embodiment of the invention, the applause device may be included in a system that is capable of controlling the applause device. The system may include a central control center for remotely controlling the applause device. For instance, central control device may cause the applause device to make applause sounds after a team has made a good play at a sporting event. In another example, a user may use the applause device to purchase tickets to events, such as, sporting events and performances.

BRIEF DESCRIPTION OF THE DRAWINGS

There are shown in the drawings some embodiments which are presently preferred, it being understood, however, that the invention is not limited to the precise arrangements and instrumentalities shown, wherein.

DETAILED DESCRIPTION OF THE PREFERRED EMBODIMENTS

Figure 1:
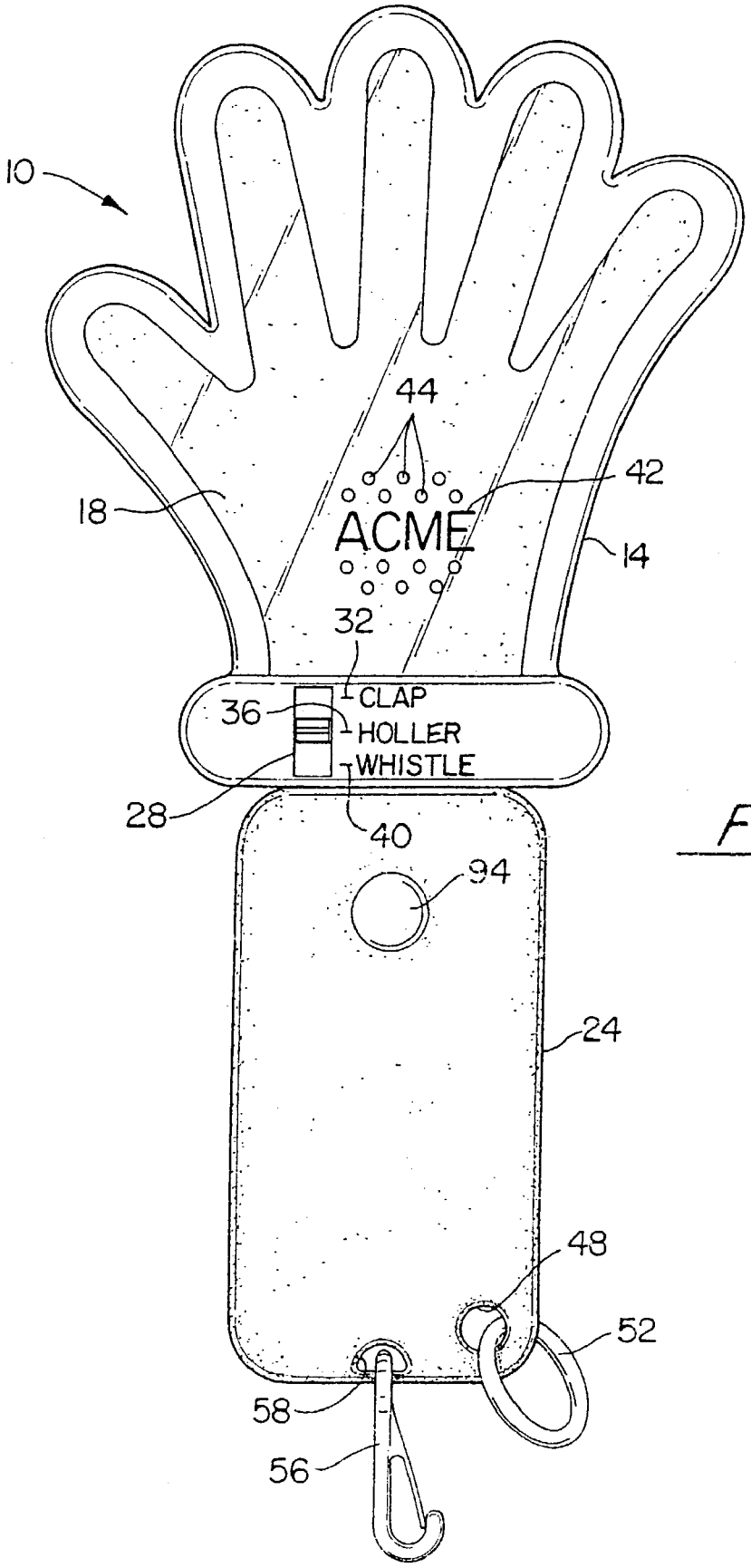
FIG. 1 is a plan view of an applause device according to the invention.
Figure 2:
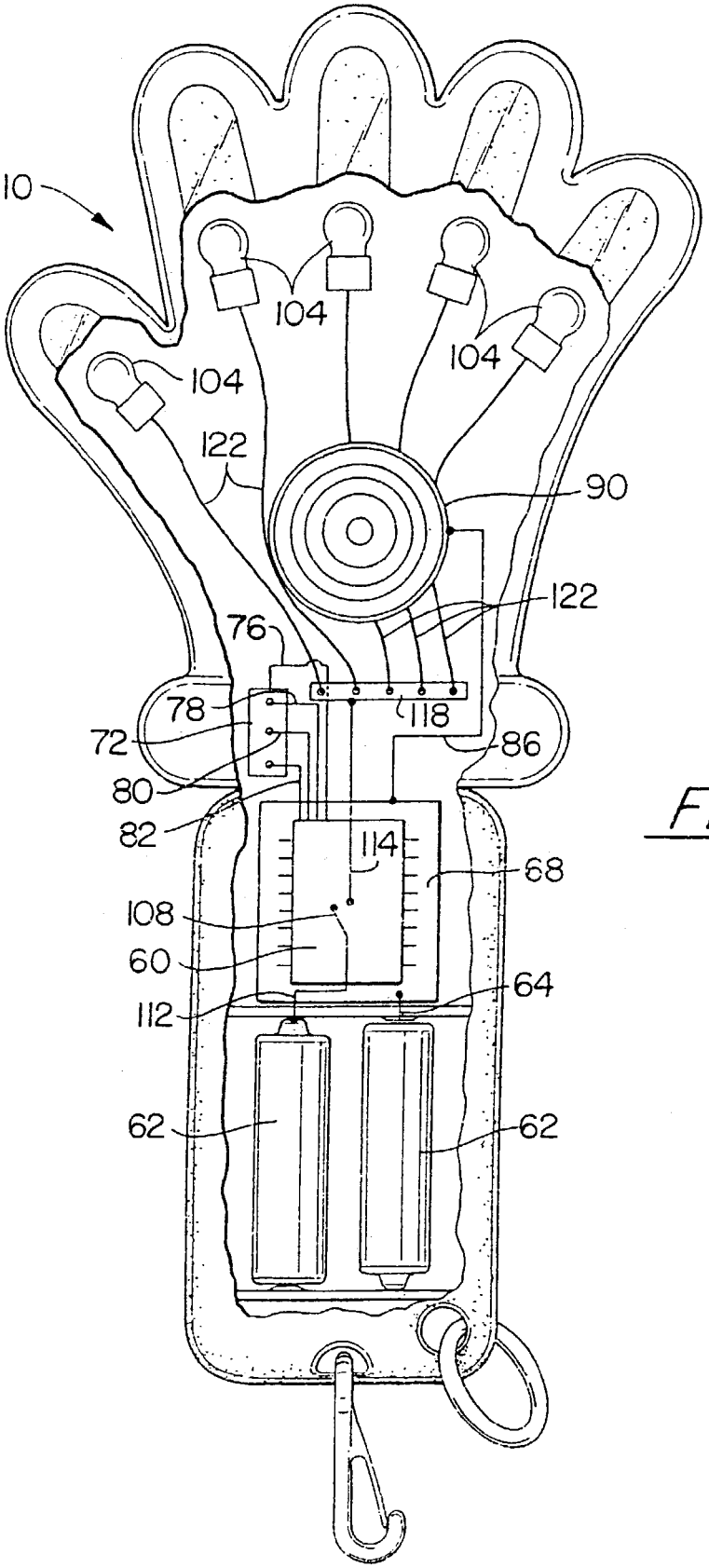
FIG. 2 is a plan view partially broken away to reveal interior features.

An applause device 10, according to the invention, is shown in FIGS. 1–2. The applause device 10 can have a housing 14 with an open interior. At least a portion of the housing 14 preferably comprises a light-emitting portion 18.

At least a portion of the housing 14 and/or the light-emitting portion 18 can have any identifiable shape, such as a shape which can be associated with a particular event, place, individual, logo, or team. In a particularly preferably embodiment, at least a portion of the housing 14 and/or the light-emitting portion 18 are shaped to suggest a human hand. This suggestion facilitates the communication of applause on behalf of the user.

The housing 14 can also have a handle section 24 with which the user can grasp the applause device 10. A switch 28 can be provided with which to generate the applause sounds. The switch 28 can be located on any portion of the applause device 10, and is preferably located on the handle section 24. As shown in FIG. 1, the switch 28 can have a number of different positions so as to permit the user to select among different applause sounds. In the embodiment shown, a switch position 32 is used to generate a clapping sound, a switch position 36 is used to generate a holler sound, and a switch position 40 is used to generate a whistle sound. More or fewer sounds, or other applause sounds, are alternatively possible. In this regard, it is understood that any sound which indicates approval or disapproval is acceptable. Examples of sounds which can suggest disapproval include booing and hissing.

The switch 28 can be of any suitable design, and in the embodiment shown the switch 28 is a slide switch which moves between the switch positions 32, 36, and 40 so as to permit the user to make a desired selection. In FIG. 1, the switch 28 is shown in switch position 36, which is used to generate a holler sound.

In a preferred embodiment, written indicia 42 can be incorporated into an outer surface of the housing 14. The written indicia 42 can be any name, symbol, logo, or other identifying mark, such as those associated with a particular event, place, logo, slogan, flag, or team. The housing 14 can also have an attachment slot 48, through which any suitable attachment structure can be disposed to attach the applause device 10 to another object. The attachment slot 48 can be located on any suitable portion of the applause device 10, and is preferably located on the handle section 24. Any suitable attachment structure is acceptable, such as a ring 52. The ring 52 can be used as a keychain ring.

Alternatively, attachment structure can be attached to the applause device 10 without the use of an attachment slot 48. For example, the attachment structure can be adhesively or mechanically connected directly to any suitable portion of the housing 14. Examples of acceptable adhesive and mechanical structure include any type of glue, a screw, a bolt, or synthetic materials which detachably connect when pressed together, such as VELCRO. It is understood, however, that the invention is not limited to these examples. As shown in the preferred embodiment of FIG. 1, the attachment structure can be a hook 56 connected directly to a portion of the housing 14 with a screw 58.

A plurality of apertures 44 can be provided in the housing 14 so as to permit sound generated by the applause device 10 to more efficiently escape from the housing 14. Sound generating devices that can be preprogrammed with one or more sounds are well known in the art, and the applause device 10 can generate one or more sounds using any suitable sound generating device. For example, it is known to preprogram a sound generating circuit to produce the sound of a police siren or a machine gun.

Any suitable sound generating device is acceptable for use with the invention, such as sound generating device 60, shown in FIG. 2. The sound generating device 60 can receive power from one or more batteries 62, which are connected by a suitable connection 64 to the sound generating device 60. The sound generating device 60 can be mounted on a suitable platform 68, such as a printed circuit board, as is known in the art. The switch 28 is operable to make a connection between at least one power contact 72, which can receive power from the sound generating device 60 through line 76. Return lines 78, 80, and 82 can be used in connection with switch positions 32, 36, and 40, respectively. As is known in the art, the movement of the switch 28 will complete a circuit between the contact 72 and one of the return lines 78, 80, and 82 to indicate to the sound generating device 60 which sound has been selected. A line 86 leads from the sound generating device 60 to an audio transducer 90, such as a speaker, which helps generate the appropriate sound.

The housing 14 can be illuminated in any suitable manner. For example, in the preferred embodiment of FIGS. 1 and 2, a switch 94 is provided in the housing 14 so as to permit one or more lights to be turned on within the housing 14, thereby illuminating the light-emitting portion 18. In an alternative example, the light-emitting function can be activated by another switch position of the switch 28.

The housing 14 and/or light-emitting portion 18 is preferably shaped so as to suggest the shape of an open hand to provide a visual expression of approval, although the invention is not limited in that regard. For example, the housing 14 or light-emitting portion 18 can be shaped so as to suggest disapproval. In another embodiment, housing 14 and/or light-emitting portion 18 may be shaped as a logo, such as for a team; an animal shape, such as an elephant, donkey, or other animal; a character so that when the applause device 10 placed next to other applause devices 10, a word or name of, for instance, a political candidate, is spelled out.

The switch 94 can be of any suitable design, and in the embodiment shown is a push button toggle switch. The housing 14 and/or light-emitting portion 18 is suitably fashioned by several methods, but preferably is transparent or translucent and has lights to emit light through the transparent or translucent portion. The lights can be any suitable lighting, including fluorescent lighting, light-emitting diodes, or incandescent bulbs, all of which are known in the art. In the embodiment shown, a plurality of incandescent bulbs 104 is provided so as to more evenly emit light from the light-emitting portion 18. It is understood that lights can be located at any suitable portion of the device 10.

The bulbs 104 are powered by means of a switch 108 which is operated by the switch 94. Power is provided by any suitable means, such as a connection 112 extending from the batteries 62. Power can extend through a line 114 to a bus 118, wherein a plurality of lines 122 extend to the bulbs 104.

Figure 3:
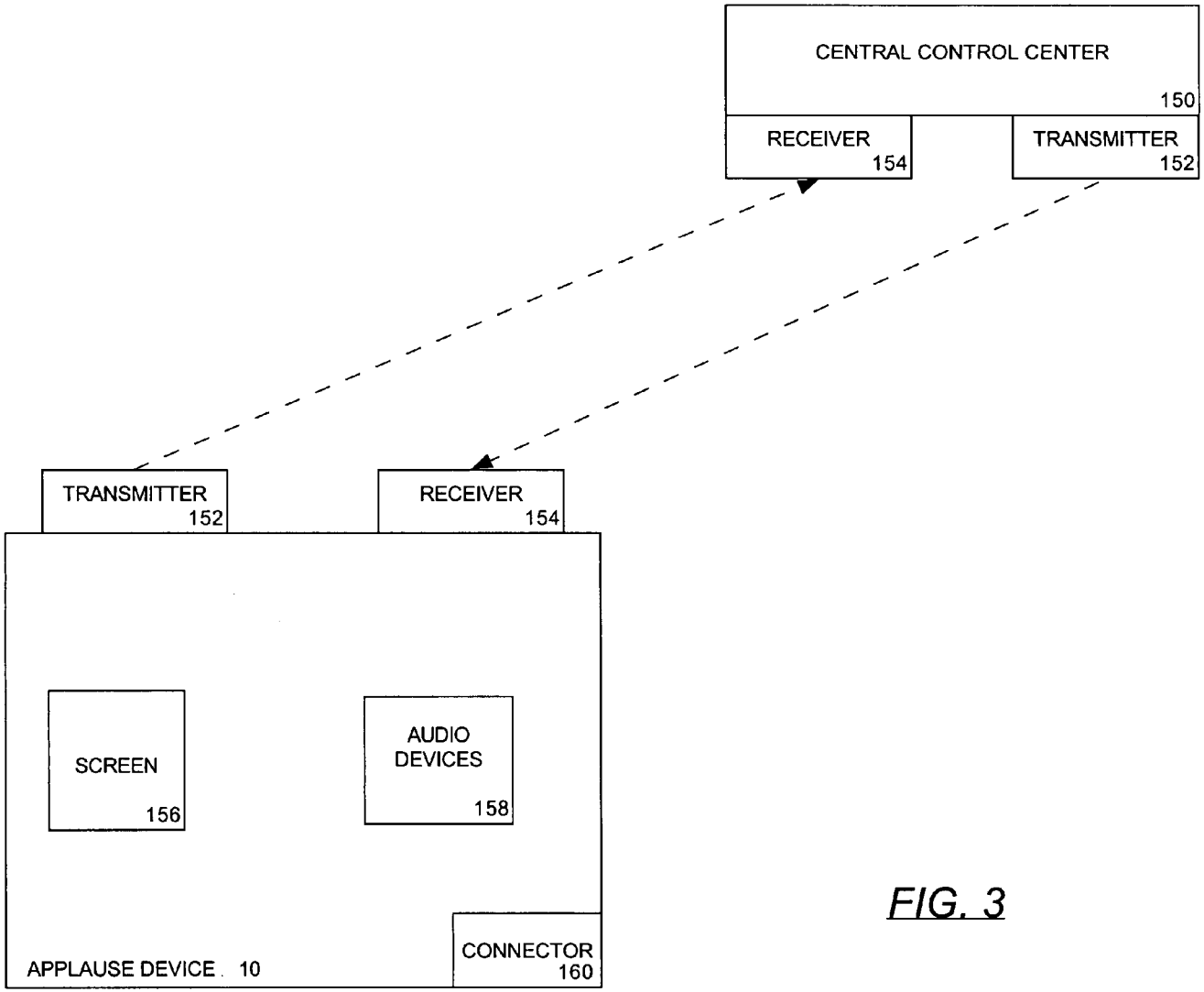
FIG. 3 is a schematic diagram of an applause communication system of this invention.

In another embodiment, applause device 10 may communicate with a central control center 150, as shown in FIG. 3. Central control center 150 may be used to control the audio and light functions of applause device 10 previously described. In addition, central control center 150 may instruct applause device 10 to play congratulatory messages or noises, disapproval messages or noises, cheers, and other audio messages. For instance, when a home team in a sports event makes a good play, central control center 150 may activate applause device 10 to produce a cheering sound. At other times, central control center 150 may activate applause device 10 to play a team's fight song or other type of song.

Central control center 150 may be a personal computer, a microcontroller or other device capable of controlling applause device 10. Central control center 150 may communicate with applause device 10 using wireless technology, conventional wired technologies, or other devices. If applause device 10 communicates using wireless technology, central control center 150 and applause device 10 may each include a transmitter 152 and receiver 154 for transmitting and receiving wireless signals respectively. In another embodiment, central control center 150 may be coupled to applause device 10 through conventional wireline systems. For instance, applause device 10 may be used in an auditorium or other location in which each seat has a connector 160, such as a modular jack, for connecting applause device 10 to central control center 150. Each connector is coupled to a network of wires that is ultimately coupled to central control center 150. Attaching applause device 10 to a releasable connector 160 allows applause device 10 to be taken with a user when the user leaves a particular seat.

A user may communicate with central control center 150 to order tickets for events, such as, but not limited to, sporting events, concerts, performances, recitals, plays, and other events. The user may order the tickets while the user is attending another event. A user may also communicate opinions or participate in a poll using applause device 10. Applause device 10 may present a user with these options either visually, using, for instance, a screen 156, or audio devices, such as speakers 158. A user may enter the user's choice using numerous methods, such as, but not limited to, speaking into a microphone, depressing keys located on the applause device 10, or others.

It should be understood that the examples and embodiments described herein are for illustrative purposes only and that various modifications or changes in light thereof will be obvious to persons skilled in the art, and that such modifications or changes are to be included within the spirit and purview of this application. Moreover, the invention can take other specific forms without departing from the spirit or essential attributes thereof.

I claim:

1. An applause communication system, comprising:

an applause communication device formed by a housing having a sound generating device and a lighting structure, wherein at least a portion of the housing is formed of at least one of translucent and transparent materials, so that the lighting structure can illuminate at least a portion of the housing; and a central control center in communication with the applause communication device and capable of controlling the sound generating device and the lighting structure; and wherein the central control center signals the applause communication device to generate a sound selected from the group consisting of approval sounds and disapproval sounds.

2. The applause communication system of claim 1, wherein the central control center and the applause communication device can communicate using wireless technology.

3. The applause communication system of claim 2, wherein the applause communication device further comprises a receiver and the central control center further comprises a transmitter for transmitting signals from the central control center to the applause communication device.

4. The applause communication system of claim 2, wherein the central control center further comprises a receiver and the applause communication device further comprises a transmitter for transmitting signals from the applause communication device to the central control center.

5. The applause communication system of claim 1, wherein the housing of the applause communication device is shaped as a logo.

6. The applause communication system of claim 1, wherein the housing of the applause communication device is shaped as at least one character.

7. The applause communication system of claim 1, wherein the applause communication device is capable of playing a song.

8. The applause communication system of claim 1, wherein the applause communication device is capable of receiving at least one votes and communicating the at least one votes to the central control center.

9. The applause communication system of claim 1, wherein the applause communication device is capable of receiving a ticket order and communicating the ticket order to the central control center.

10. The applause communication system of claim 1, further comprising a wireline network for coupling at least one applause communication devices to at least one central control centers.

11. The applause communication system of claim 10, wherein the wireline network further comprises at least one connectors for coupling at least one applause communication devices to the wireline network.

12. The applause communication system of claim 1, further comprising a display screen.

* * * * *